US005158044A

United States Patent [19]

Kawamura

[11] Patent Number: 5,158,044

[45] Date of Patent: Oct. 27, 1992

[54] ENGINE SELECTIVELY OPERABLE IN TWO- AND FOUR-CYCLE MODES

[75] Inventor: Hideo Kawamura, Samukawa, Japan

[73] Assignee: Isuzu Ceramics Research Institute Co., Ltd., Fujisawa, Japan

[21] Appl. No.: 757,183

[22] Filed: Sep. 10, 1991

[30] Foreign Application Priority Data

Sep. 10, 1990 [JP] Japan ..... 2-239705
Oct. 4, 1990 [JP] Japan ..... 2-267031

[51] Int. Cl.[5] ..... F02B 69/06
[52] U.S. Cl. ..... 123/21
[58] Field of Search ..... 123/21, 90.17, 90.27, 123/90.31, 90.14, 90.12

[56] References Cited

U.S. PATENT DOCUMENTS

| | | | |
|---|---|---|---|
| 871,602 | 11/1907 | Loffler | 123/21 |
| 1,792,028 | 2/1931 | Peterson | 123/21 |
| 2,178,152 | 10/1939 | Walker | 123/21 |
| 4,392,459 | 7/1983 | Chareire | 123/21 |
| 4,535,733 | 8/1985 | Honda | 123/90.17 |
| 4,546,735 | 10/1985 | O'Neal | 123/90.17 |
| 4,664,070 | 5/1987 | Meistrick et al. | 123/21 |

*Primary Examiner*—David A. Okonsky
*Attorney, Agent, or Firm*—Staas & Halsey

[57] ABSTRACT

An engine is selectively operable in two- and four-cycle modes by varying the timing to open and close intake and exhaust valves on the top of a cylinder. The engine comprises first and second valve actuating mechanisms for opening and closing the intake and exhaust valves, a selective operating mechanism for operating the first valve actuating mechanism to open and close the intake and exhaust valves while the second valve actuating mechanism is disabled, and for operating the second valve actuating mechanism to open and close the intake and exhaust valves while the first valve actuating mechanism is disabled, and a rotation transmitting mechanism for transmitting rotation of a crankshaft of the engine, each time the crankshaft makes two revolutions, to the first valve actuating mechanism through the selective operating mechanism when the engine operates in the four-cycle mode, and for transmitting rotation of the crankshaft, each time the crankshaft makes one revolution, to the second valve actuating mechanism through the selective operating mechanism when the engine operates in the two-cycle mode. The rotation transmitting mechanism starts to transmit rotation of the crankshaft to the first and second valve actuating mechanism when the crankshaft has been angularly moved through a predetermined angle.

5 Claims, 7 Drawing Sheets

FIG. 1
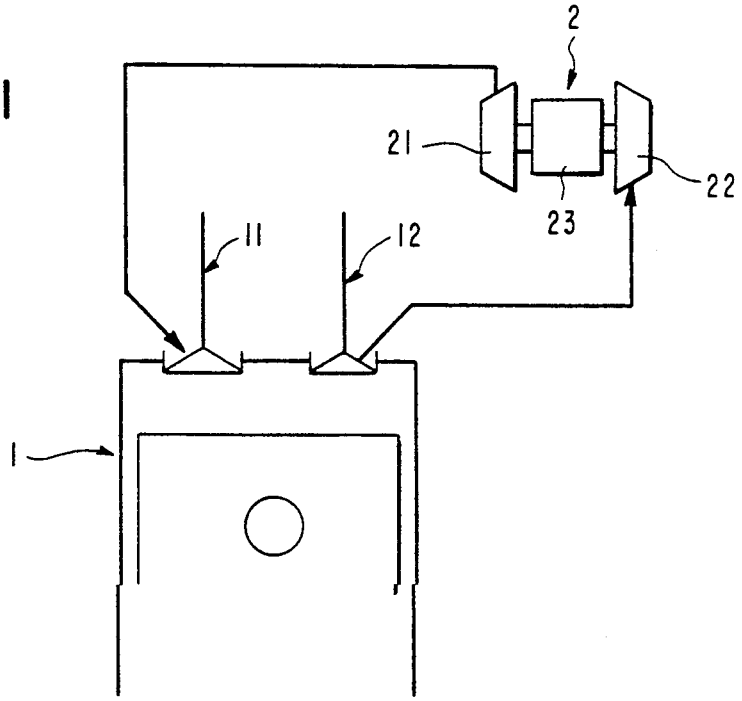
FIG. 2(a)
FIG. 2(b)
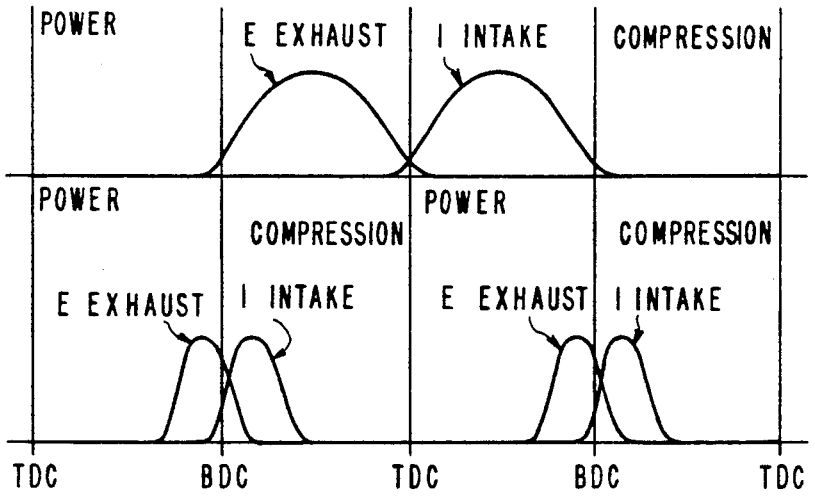

ENGINE SELECTIVELY OPERABLE IN TWO- AND FOUR-CYCLE MODES

BACKGROUND OF THE INVENTION

1. Field of the Invention

The present invention relates to an engine that is selectively operable in two- and four-cycle modes depending on the rotational speed of the engine and the load on the engine.

2. Description of the Prior Art

Conventional reciprocal-piston engines are roughly classified into two-cycle engines in which intake, compression, power, and exhaust strokes occur while the piston reciprocates once, i.e., the crankshaft makes one revolution, and four-cycle engines in which intake, compression, power, and exhaust strokes occur while the piston reciprocates twice, i.e., the crankshaft makes two revolutions.

In the two-cycle engines, the intake and exhaust strokes are effected around the bottom dead center of the piston, and the power stroke is effected each time the crankshaft makes one revolution. Therefore, the two-cycle engines suffer lower fluctuations of the rotational speed of the output shaft, and can produce a higher torque.

In the four-cycle engines, since intake and exhaust strokes occur independently of each other, the exhaust gases are fully replaced with a new air-fuel mixture. Accordingly, the four-cycle engines are more advantageous than the two-cycle engines in that the exhaust gases are cleaner, and the fuel consumption in high-speed engine operation is lower.

Inasmuch as the two- and four-cycle engines have different operating characteristics, an engine which can operate as a two-cycle engine in a low-speed operation range and as a four-cycle engine in a high-speed operation range is expected to offer the advantages of both two- and four-cycle engines.

However, it is highly difficult to change the timing to open and close the intake and exhaust valves while the engine is in operation. There has not been available an engine having a practically feasible mechanism for modifying the timing to open and close the intake and exhaust valves.

SUMMARY OF THE INVENTION

In view of the aforesaid drawbacks of the conventional engines, it is an object of the present invention to provide a practical engine that is selectively operable in two- and four-cycle modes.

According to the present invention, there is provided an engine selectively operable in two- and four-cycle modes by varying the timing to open and close intake and exhaust valves on the top of a cylinder, comprising first valve actuating means for opening and closing the intake and exhaust valves, second valve actuating means for opening and closing the intake and exhaust valves, selective operating means for operating the first valve actuating means to open and close the intake and exhaust valves while the second valve actuating means is disabled, and for operating the second valve actuating means to open and close the intake and exhaust valves while the first valve actuating means is disabled, and rotation transmitting means for transmitting rotation of a crankshaft of the engine, each time the crankshaft makes two revolutions, to the first valve actuating means through the selective operating means when the engine operates in the four-cycle mode, and for transmitting rotation of the crankshaft, each time the crankshaft makes one revolution, to the second valve actuating means through the selective operating means when the engine operates in the two-cycle mode. The rotation transmitting means comprises means for starting to transmit rotation of the crankshaft to the first and second valve actuating means when the crankshaft has been angularly moved through a predetermined angle.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIG. 1 is a schematic diagram showing an engine according to the present invention;

FIGS. 2(*a*) and 2(*b*) are diagrams showing cam profiles indicative of the relationship between the cam lift of intake and exhaust valves and the rotational phase of the engine;

DETAILED DESCRIPTION OF THE PREFERRED EMBODIMENTS

Figure 3:
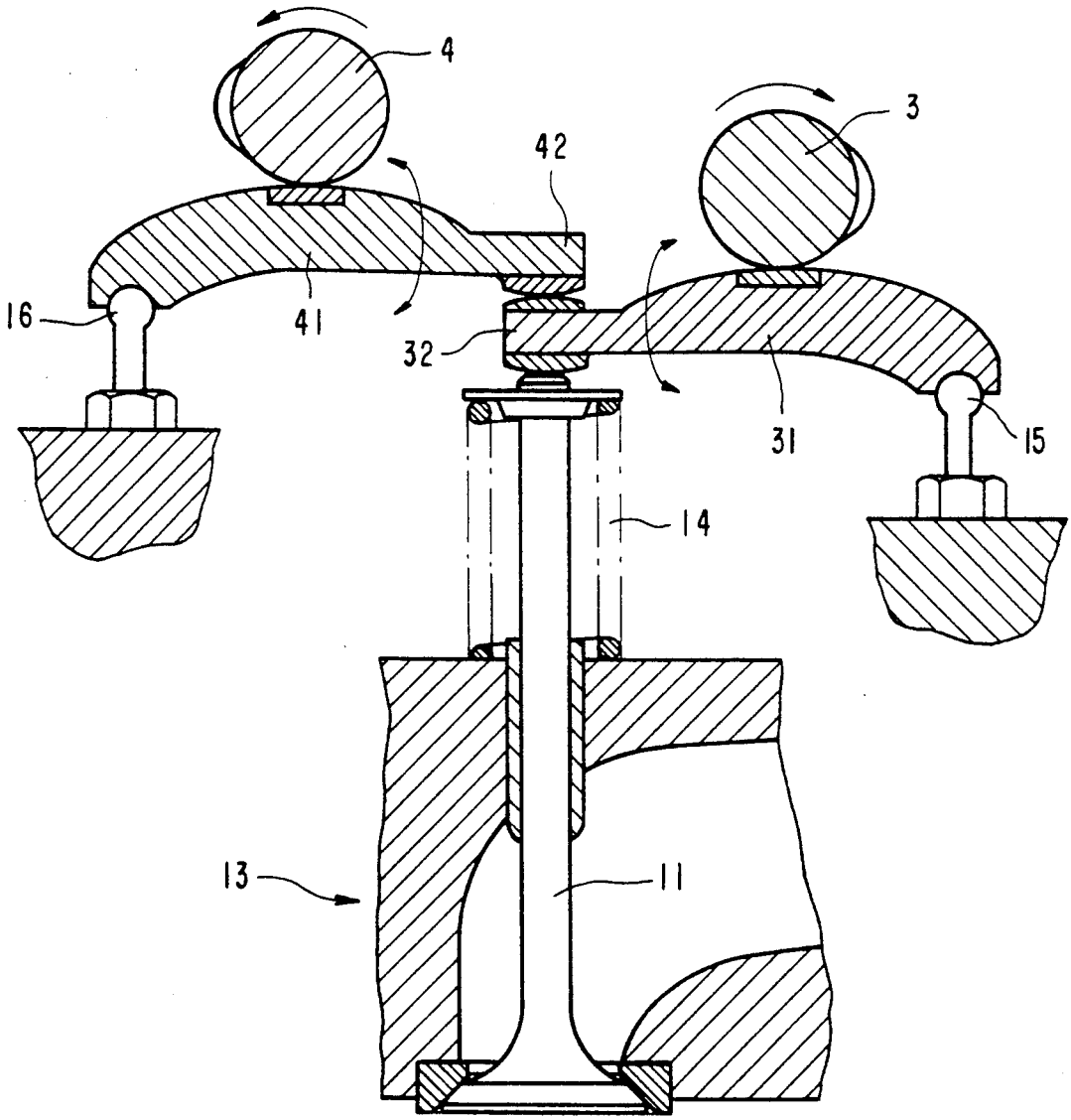
FIG. 3 is a fragmentary cross-sectional view of a valve and camshafts.

FIG. 1 schematically shows an engine according to the present invention. The engine, generally designated by the reference numeral 1, has intake and exhaust valves 11, 12 as with an ordinary four-cycle engine.

A turbocharger 2 has a turbine 22 that can be rotated by exhaust gases discharged from the engine 1 through the exhaust valve 12, and a compressor 21 that rotates with the turbine 22 to supply compressed intake air into the engine 1 through the intake valve 11.

The compressor 21 and the turbine 22 are interconnected by a shaft to which a rotary electric machine 23 is coupled. When a larger amount of exhaust gases is discharged by the engine, the turbine 22 drives the compressor 21 to supercharge the engine 1, and also the rotary electric machine 23 is operated as an electric generator by the excess torque of the turbine 22 for the recovery of the exhaust energy. When a smaller amount of exhaust gases is discharged by the engine, the rotary electric machine 23 is operated as an electric motor by electric energy from a power supply such as a battery for assisting the compressor 21 in supercharging the engine 1.

The engine 1 can operate as a two-cycle engine or a four-cycle engine when the timing to open and close the intake and exhaust valves 11, 12 is modified.

The timing to open and closing the intake and exhaust valves 11, 12 will be described below.

FIGS. 2(*a*) and 2(*b*) show cam profiles indicative of the relationship between the lift of the intake and exhaust valves and the rotational phase of the engine. The timing to open and close the intake valve 11 is represented by I, and the timing to open and close the exhaust valve 12 is represented by E.

FIG. 2(*a*) illustrates the timing to open and close the intake and exhaust valves when the engine operates in a four-cycle mode. The illustrated timing is the same as the timing to open and close intake and exhaust valves of an ordinary four-cycle engine. When the piston starts to ascend from the bottom dead center (BDC) after the power stroke, the exhaust valve 12 starts to open. The exhaust valve 12 remains open to discharge the exhaust gases from the combustion chamber until the piston reaches the top dead center (TDC). When the piston reaches the top dead center, the exhaust stroke ends, and the exhaust valve 12 is closed. Then, the intake valve 11 starts to open. As the piston descends, fresh air is supplied into the combustion chamber through the intake valve 11. When the piston reaches the bottom dead center, the intake valve 11 is closed. Then, the compression stroke starts with ascent of the piston.

FIG. 2(*b*) illustrates the timing to open and close the intake and exhaust valves when the engine operates in a two-cycle mode. In the two-cycle mode, when the piston approaches the bottom dead center (BDC) in the power stroke, the exhaust valve 12 opens to discharge the exhaust gases from the combustion chamber. When the piston is positioned nearly the bottom dead center, intake air compressed by the compressor 21 is supplied into the combustion chamber, forcibly discharging remaining exhaust gases out of the combustion chamber through the exhaust valve 12.

After the exhaust gases have been discharged, the exhaust valve 12 is closed, and the compressed intake air is continuously introduced into the combustion chamber until the combustion chamber is filled with the intake air. After the combustion chamber has been charged with fresh air, the intake valve 11 is closed, and the compression stroke starts.

A mechanism for modifying the timing to open and close the intake and exhaust valves will be described below.

Figure 4:
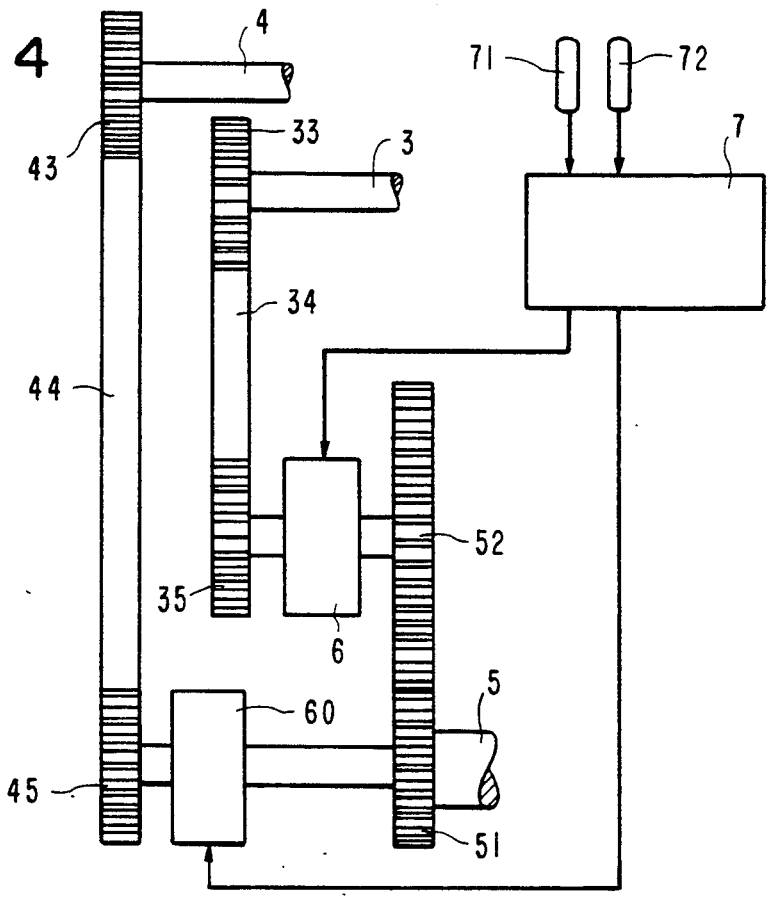
FIG. 4 is a view showing a mechanism for rotating the camshafts shown in FIG. 3.

FIG. 3 shows the relationship between a valve and camshafts, and FIG. 4 shows a mechanism for actuating the camshafts shown in FIG. 3.

Since the intake and exhaust valves 11, 12 are actuated by identical mechanisms, respectively, only the mechanism for actuating the intake valve 11 will be described below.

The intake valve 11 is slidably supported on a cylinder head 13 with a valve spring 14 acting between the intake valve 11 and the cylinder head 13. The intake valve 11 is normally urged in a closing direction under the bias of the valve spring 14.

A four-cycle-mode camshaft 3 is held in slidable contact with an intermediate portion of a rocker arm 31 whose one end is supported on a pivot 15. When the camshaft 3 rotates about its own axis, the rocker arm 31 is angularly moved thereby about the pivot 15 in the direction indicated by the arrow. The rocker arm 31 has a tip end 32 held against the shank end of the intake valve 11. When angularly moved about the pivot 15, the rocker arm 31 opens and closes the intake valve 11.

A timing pulley 33 is coupled to an end of the camshaft 3, and operatively coupled to a timing pulley 35 through a timing belt 34. The timing pulleys 33, 35 have the same diameter.

A two-cycle-mode camshaft 4 is held in slidable contact with an intermediate portion of a rocker arm 41 whose one end is supported on a pivot 16. When the camshaft 4 rotates about its own axis, the rocker arm 41 is angularly moved thereby about the pivot 16 in the direction indicated by the arrow. The rocker arm 41 has a tip end 42 held against the shank end of the intake valve 11 through the tip end 32 of the rocker arm 31. When angularly moved about the pivot 16, the rocker arm 41 opens and closes the intake valve 11.

A timing pulley 43 is coupled to an end of the camshaft 4, and operatively coupled to a timing pulley 45 through a timing belt 44. The timing pulleys 43, 45 have the same diameter.

A crankshaft gear 51 is coupled to an end of a crankshaft 5, and held in mesh with a driven gear 52. The driven gear 52 has gear teeth, the number of which is twice the number of gear teeth of the crankshaft gear 51. Therefore, the driven gear 52 rotates at a speed which is half the rotational speed of the crankshaft 5. The timing pulley 35 is disconnectably coupled to the driven gear 52 by an electromagnetic clutch 6. In response to a signal from a controller 7, the electromagnetic clutch 6 connects the timing pulley 35 to the driven gear 52 for synchronous rotation. Similarly, the timing pulley 45 is disconnectably coupled to the crankshaft gear 51 by an electromagnetic clutch 60. In response to a signal from the controller 7, the electromagnetic clutch 60 connects the timing pulley 45 to the crankshaft gear 51 for synchronous rotation.

The controller 7 comprises an input/output interface for transmitting signals to and receiving signals from external devices, a ROM for storing a control program and various data, a CPU for effecting arithmetic operations based on the control program stored in the ROM, a RAM for temporarily storing the results of the arithmetic operations and various data, and a control memory for controlling the flow of signals within the controller 7.

To the controller 7, there are connected a rotation sensor 71 for detecting the rotational speed and phase of the engine 1, and a load sensor 72 for detecting the load on the engine. Detected signals from the sensors 71, 72 are supplied to the controller 7 through its input/output interface.

Based on the supplied signals from the sensors 71, 72, the controller 7 operates the engine in the two-cycle mode when it operates in a low speed range under a high load, and operates the engine in the four-cycle mode otherwise.

When the two-cycle mode is selected, the controller 7 actuates the electromagnetic clutch 60 to rotate the camshaft 4 about its own axis. When the four-cycle mode is selected, the controller 7 actuates the electromagnetic clutch 6 to rotate the camshaft 3 about its own axis.

Each of the electromagnetic clutches 6, 60 is capable of transmitting torques and also of synchronizing rotational phases.

The structure of the electromagnetic clutches 6, 60 will be described below.

Figure 5:
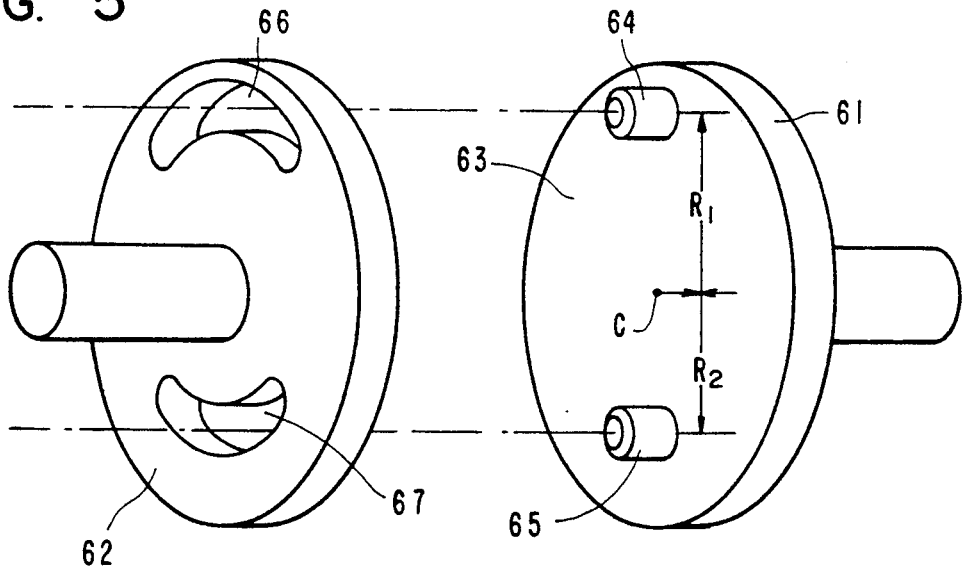
FIG. 5 is a perspective view of an electromagnetic clutch.

FIG. 5 shows the structure of the electromagnetic clutches. The electromagnetic clutches 6, 60 are identical in structure to each other. Each of the electromagnetic clutches 6, 60 has a clutch plate 61 and a clutch plate 62, and also an electromagnetic solenoid (not shown) for displacing the clutch plates 61, 62 toward and away from each other in response to the application and removal of a voltage to and from the solenoid.

Pins 64, 65 are movably mounted on the surface of the clutch plate 61 which faces the clutch plate 62. The pins 64, 65 can be retracted into and projected from the clutch plate 61 under electromagnetic forces that are produced in response to an external signal. The pins 64, 65 are radially outwardly spaced from the center C of the clutch plate 61 by different distances R1, R2, respectively. The clutch plate 62 have arcuate slots 66, 67 defined respectively therein in axially confronting relationship to the pins 64, 65, respectively.

When torques are to be transmitted by the clutch, the electromagnetic solenoid is energized to displace the clutch plates 61, 62 toward each other with the pins 64, 65 retracted into the clutch plate 61.

Then, the pins 64, 65 are projected toward the clutch plate 62, and placed into the slots 66, 67, respectively, when the pins 64, 65 are axially aligned with the slots 66, 67. As the clutch plates 61, 62 slip against each other, the pins 64, 65 move in the respective slots 66, 67 until the pins 64, 67 abut against ends of the slots 66, 67 whereupon the clutch plates 61, 62 rotate together in complete synchronism with each other.

When the clutches 6, 60 are thus engaged, the camshafts 3, 4 are operatively coupled to the crankshaft 5 in constant phase relationship.

While the clutch plates 61, 62 and the pins 64, 65 are electromagnetically actuated, they may be actuated under fluid pressure such as hydraulic pressure.

A modified mechanism for varying the timing to open and close the intake and exhaust valves will be described below with reference to FIG. 6.

A four-cycle-mode camshaft 3, identical to the camshaft 3 shown in FIG. 3, is coupled to the driven gear 52 without the electromagnetic clutch 6 interposed therebetween. Therefore, the camshaft 3 always rotates at a speed which is half the rotational speed of the crankshaft 5.

A composite rocker arm 8 is angularly movable about a shaft 81 that has two hydraulic pressure passages defined therein and communicating with a cylinder mechanism 84 through respective passages 82, 83 defined in the rocker arm 8. The composite rocker arm 8 has a tip end 87 held in contact with the shank end of the intake valve 11 at all times.

Figure 6:
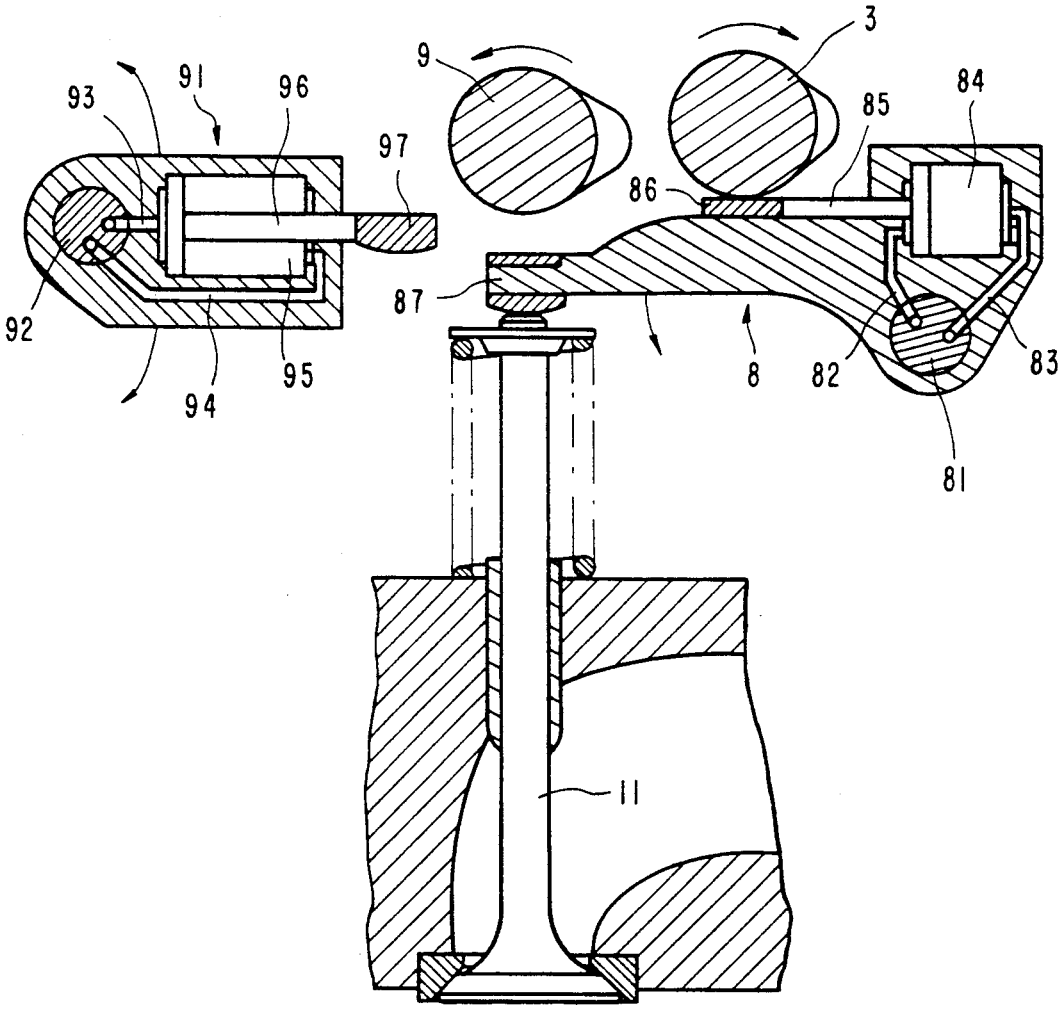
FIG. 6 is a fragmentary cross-sectional view of a modified mechanism for changing the timing to open and close intake and exhaust valves.

The cylinder mechanism 84 has a piston 85 having a rod end 86, which is interposed between the camshaft 3 and the composite rocker arm 8 when the piston 85 is in its forward end position as shown in FIG. 6. When the piston 85 is in its rearward end position, the camshaft 3 is held out of contact with the composite rocker arm 8, and hence the intake valve 11 is not actuated by the composite rocker arm 8.

A two-cycle-mode camshaft 9 also rotates at all times with the crankshaft of the engine. The camshaft 9 rotates at the same speed as the crankshaft, and hence at a speed that is twice the rotational speed of the camshaft 3.

The camshaft 9 is disposed above the intake valve 11 in coaxial relationship thereto, and spaced a distance from the tip end 87 of the composite rocker arm 8. In the illustrated condition, the camshaft 9 is held out of contact with the tip end 87, and does not actuate the intake valve 11 through the tip end 87. A coupling unit 91 is angularly movable about a shaft 92 that has two hydraulic pressure passages defined therein and communicating with a cylinder mechanism 95 through respective passages 93, 94 defined in the coupling unit 91.

The cylinder mechanism 95 has a piston 96 having a rod end 97, which is interposed between the camshaft 9 and the tip end 87 when the piston 96 is in its forward end position. When the piston 96 is in its rearward end position, as shown in FIG. 6, the camshaft 9 is held out of contact with the tip end 87, and hence the intake valve 11 is not actuated by the camshaft 9 as described above.

The hydraulic passages in the shafts 81, 92 are controlled by the controller 7. When the controller 7 selects the two-cycle mode, a hydraulic pressure is supplied to the passage 82 to retract the piston 85 and a hydraulic pressure is supplied to the passage 93 to push the piston 96 forwardly to project the rod end 97. The intake valve 11 is now opened and closed by the camshaft 9 through the tip end 87.

When the controller 7 selects the four-cycle mode, a hydraulic pressure is supplied to the passage 94 to retract the piston 96 and a hydraulic pressure is supplied to the passage 83 to push the piston 85 forwardly to project the rod end 86, as shown in FIG. 6. The intake valve 11 is now opened and closed by the camshaft 3 through the tip end 87.

Another embodiment of the present invention will be described below with reference to FIGS. 7 and 8.

Figure 7:
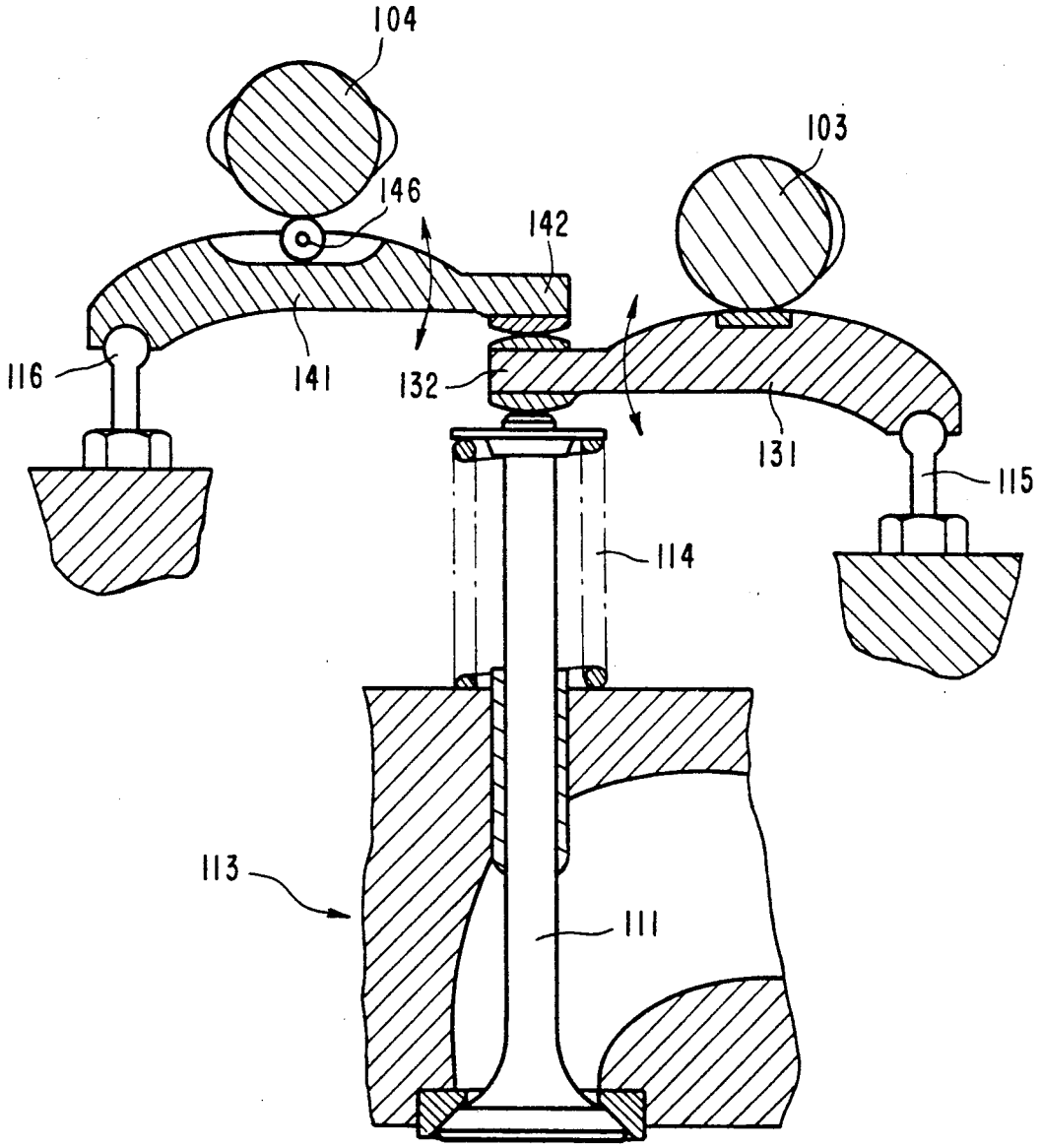
FIG. 7 is a fragmentary cross sectional view showing a valve and camshafts according to another embodiment of the present invention.
Figure 8:
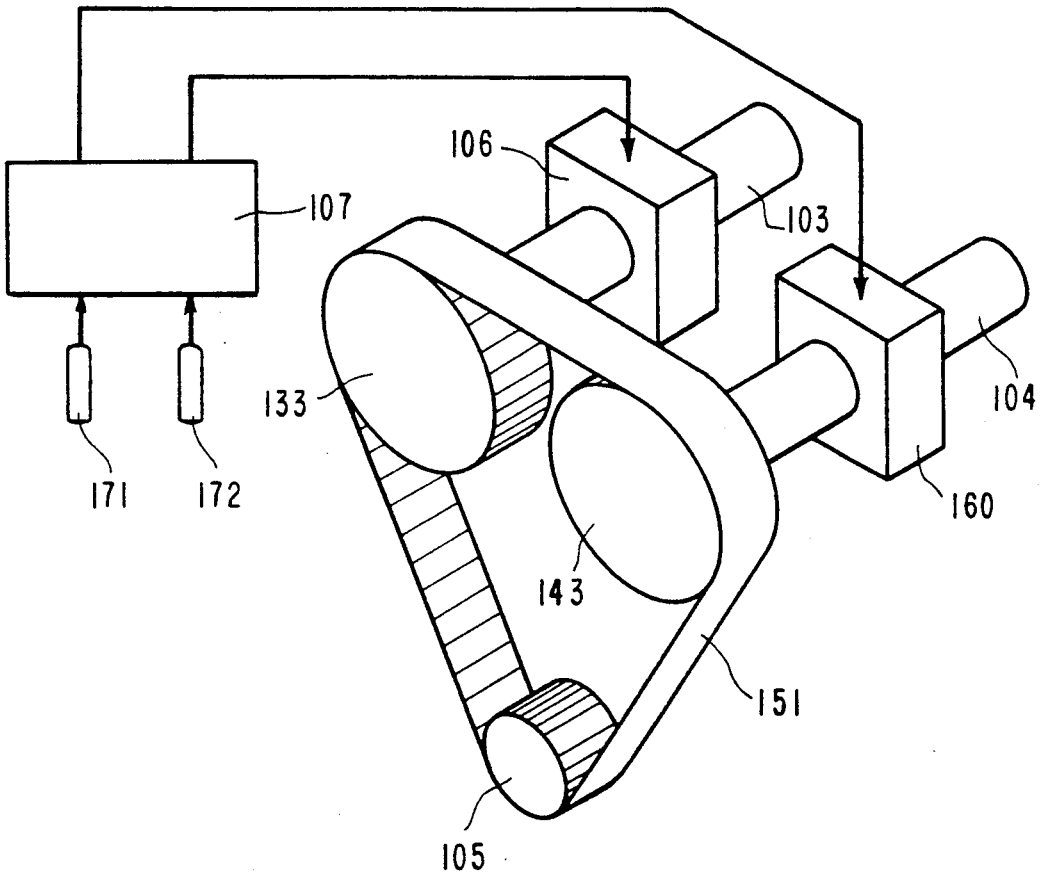
FIG. 8 is a view showing a mechanism for rotating the camshafts shown in FIG. 7.

FIG. 7 shows the relationship between a valve and camshafts, and FIG. 8 shows a mechanism for actuating the camshafts shown in FIG. 7.

Since the intake and exhaust valves are actuated by identical mechanisms, respectively, only the mechanism for actuating the intake valve will be described below.

An intake valve 111 is slidably supported on a cylinder head 113 with a valve spring 114 acting between the intake valve 111 and the cylinder head 113. The intake valve 111 is normally urged in a closing direction under the bias of the valve spring 114.

A four-cycle-mode camshaft 103 is held in slidable contact with an intermediate portion of a rocker arm 131 whose one end is supported on a pivot 115. When the camshaft 103 rotates about its own axis, the rocker arm 131 is angularly moved thereby about the pivot 115 in the direction indicated by the arrow. The rocker arm 131 has a tip end 132 held against the shank end of the intake valve 111. When angularly moved about the pivot 115, the rocker arm 131 opens and closes the intake valve 111.

A two-cycle-mode camshaft 104 has two diametrically opposite cams spaced across the center of the camshaft 104. These cams can be brought into rolling contact with a roller tappet 146 on an intermediate portion of a rocker arm 141 whose one end is supported on a pivot 116. When the camshaft 104 rotates about its own axis, the rocker arm 141 is angularly moved thereby about the pivot 116 in the direction indicated by the arrow. The rocker arm 141 has a tip end 142 held against the shank end of the intake valve 111 through the tip end 132 of the rocker arm 131. When angularly moved about the pivot 116, the rocker arm 141 opens and closes the intake valve 111.

A timing pulley 133 is coupled to an end of the camshaft 103 through an electromagnetic clutch 106, and a timing pulley 143 is coupled to an end of the camshaft 104 through an electromagnetic clutch 160. These electromagnetic clutches 106, 160 are of an internal structure which is identical to that of the electromagnetic clutches 6, 60, and will not be described in detail.

A timing pulley 105 is coupled to a crankshaft for rotation at the same speed as that of the crankshaft, and operatively connected to the timing pulleys 133, 143 through a timing belt 151. The diameter of the timing pulleys 133, 143 is twice the diameter of the timing pulley 105, so that the camshafts 103, 104 rotate at a speed which is half the rotational speed of the crankshaft.

The mechanism for actuating the camshafts as shown in FIG. 8 is advantageous for the engine layout since the camshafts 103, 104 can be rotated by one timing belt 151. As shown in FIG. 2, the intake and exhaust valves are opened and closed in shorter periods of time at larger speeds in the two-cycle mode. Since the rotational speed of the camshaft 104 is half that of the crankshaft, the roller tappet 146 is prevented from jumping off the cam surfaces on the camshaft 104. The roller tappet 146 is capable of tracing the cam profiles accurately.

A controller 107 comprises an input/output interface for transmitting signals to and receiving signals from external devices, a ROM for storing a control program and various data, a CPU for effecting arithmetic operations based on the control program stored in the ROM, a RAM for temporarily storing the results of the arithmetic operations and various data, and a control memory for controlling the flow of signals within the controller 107.

To the controller 107, there are connected a rotation sensor 171 for detecting the rotational speed and phase of the engine, and a load sensor 172 for detecting the load on the engine. Detected signals from the sensors 171, 172 are supplied to the controller 107 through its input/output interface.

Based on the supplied signals from the sensors 171, 172, the controller 107 operates the engine in the two-cycle mode when it operates in a low speed range under a high load, and operates the engine in the four-cycle mode otherwise.

When the two-cycle mode is selected, the controller 107 actuates the electromagnetic clutch 160 to rotate the camshaft 104 about its own axis. When the four-cycle mode is selected, the controller 107 actuates the electromagnetic clutch 106 to rotate the camshaft 103 about its own axis.

Figure 9:
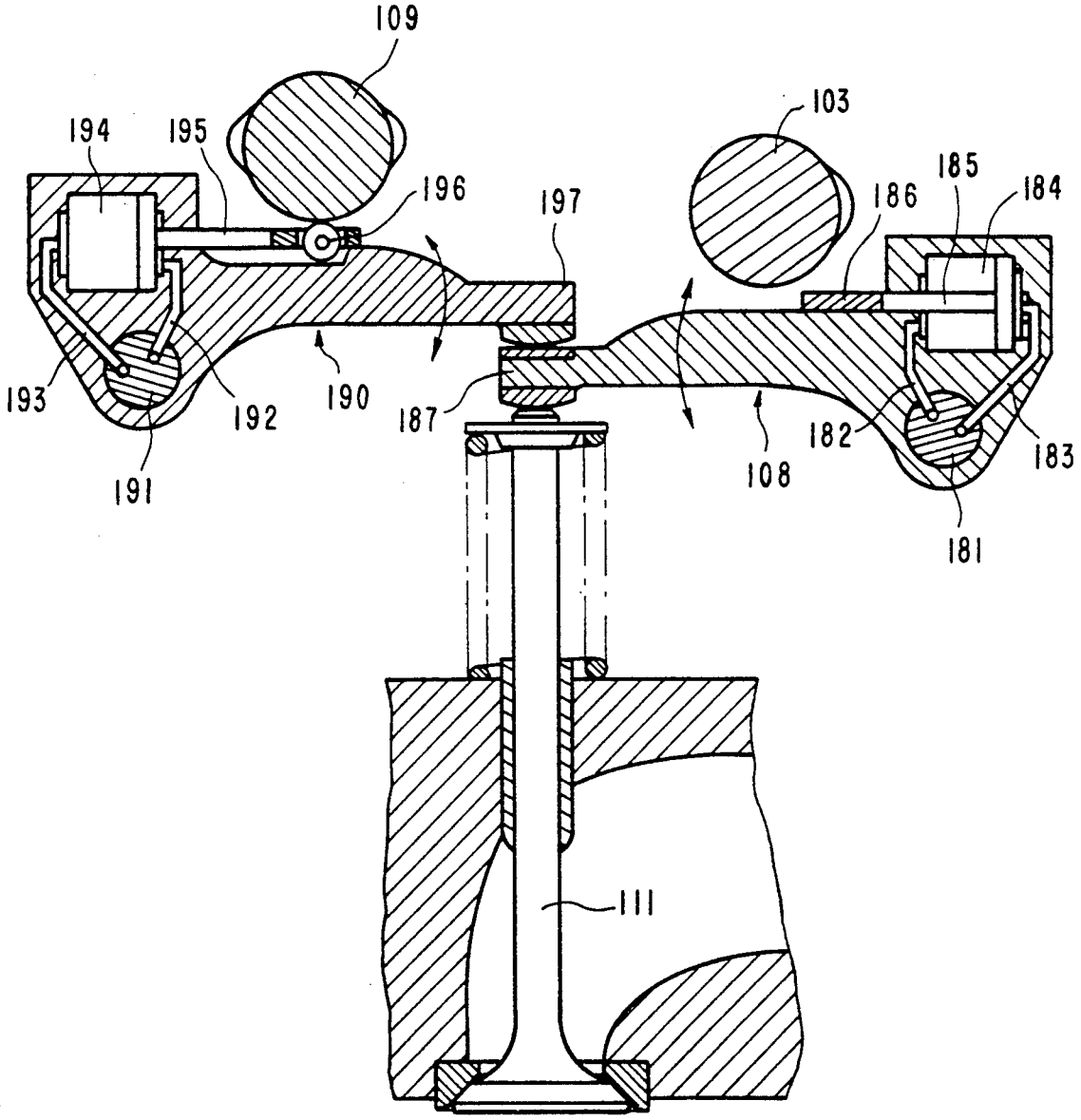
FIG. 9 is a fragmentary cross-sectional view of another modified mechanism for changing the timing to open and close intake and exhaust valves.

Another modified mechanism for varying the timing to open and close the intake and exhaust valves will be described below with reference to FIG. 9.

A four-cycle-mode camshaft 103, identical to the camshaft 103 shown in FIG. 7, is coupled to the timing pulley 133 without the electromagnetic clutch 6 interposed therebetween. Therefore, the camshaft 103 always rotates at a speed which is half the rotational speed of the crankshaft.

A composite rocker arm 108 is angularly movable about a shaft 181 that has two hydraulic pressure passages defined therein and communicating with a cylinder mechanism 184 through respective passages 182, 183 defined in the rocker arm 108. The composite rocker arm 108 has a tip end 187 held in contact with the shank end of the intake valve 111 at all times.

The cylinder mechanism 184 has a piston 185 having a rod end 186, which is interposed between the camshaft 103 and the composite rocker arm 108 when the piston 185 is in its forward end position. When the piston 185 is in its rearward end position as shown in FIG. 9, the camshaft 103 is held out of contact with the composite rocker arm 108, and hence the intake valve 111 is not actuated by the composite rocker arm 108.

A two-cycle-mode camshaft 109 is connected to the timing pulley 143 without the electromagnetic clutch 160 interposed therebetween, and hence rotates at all times at the same speed as that of the camshaft 103.

A composite rocker arm 190, similar to the composite rocker arm 108, and is angularly movable about a shaft 191 that has two hydraulic pressure passages defined therein and communicating with a cylinder mechanism 194 through respective passages 192, 193 defined in the rocker arm 109. The composite rocker arm 109 has a tip end 197 held in contact with the shank end of the intake valve 111 at all times.

The cylinder mechanism 194 has a piston 195 having a rod end that supports a roller 196 thereon. The roller 196 is interposed between the camshaft 109 and the composite rocker arm 190 when the piston 195 is in its forward end position as shown in FIG. 9. When the piston 195 is in its rearward end position, the camshaft 109 is held out of contact with the composite rocker arm 109, and hence the intake valve 111 is not actuated by the composite rocker arm 109. The composite rocker arm has a tip end 197 held against the upper surface of the tip end 187 of the composite rocker arm 108 at all times.

The hydraulic passages in the shafts 181, 191 are controlled by the controller 107. When the controller 107 selects the two-cycle mode, a hydraulic pressure is supplied to the passage 182 to retract the piston 185 and a hydraulic pressure is supplied to the passage 193 to push the piston 195 forwardly to project the rod end thereof, as shown in FIG. 9. The intake valve 111 is now opened and closed by the camshaft 109 through the tip ends 187, 197.

When the controller 107 selects the four-cycle mode, a hydraulic pressure is supplied to the passage 192 to retract the piston 195 and a hydraulic pressure is supplied to the passage 183 to push the piston 185 forwardly to project the rod end 186. The intake valve 111 is now opened and closed by the camshaft 103 through the tip end 187.

Although certain preferred embodiments of the present invention have been shown and described in detail, it should be understood that various changes and modifications may be made therein without departing from the scope of the appended claims.

What is claimed is:

1. An engine selectively operable in two- and four-cycle modes by varying the timing to open and close intake and exhaust valves on the top of a cylinder, comprising:

first valve actuating means for opening and closing the intake and exhaust valves;

second valve actuating means for opening and closing the intake and exhaust valves;

first selective operating means for operating said first valve actuating means to open and close the intake and exhaust valves while said second valve actuating means is disabled, and second selective operating means for operating said second valve actuating means to open and close the intake and exhaust valves while said first valve actuating means is disabled; and rotation transmitting means for transmitting rotation of a crankshaft of the engine, each time the crankshaft makes two revolutions, to said first valve actuating means through said first selective operating means when the engine operates in the four-cycle mode, and for transmitting rotation of the crankshaft, each time the crankshaft makes one revolution, to said second valve actuating means through said second selective operating means when the engine operates in the two-cycle mode.

2. An engine according to claim 1, wherein said rotation transmitting means comprises means for starting to transmit rotation of the crankshaft to said first and second valve actuating means when the crankshaft has been angularly moved through a predetermined angle.

3. An engine according to claim 1, wherein said first and second selective operating means comprises clutch means selectively operable for transmitting rotation of the crankshaft to said first and second valve actuating means..

4. An engine according to claim 1, wherein each of said first and second valve actuating means comprises a camshaft rotatable by the crankshaft and having a cam, and a rocker arm angularly movable by said cam, said first and second selective operating means comprising a member removably insertable between said cam and said rocker arm.

5. An engine according to claim 1, wherein each of said first and second valve actuating means comprises a camshaft rotatable by the crankshaft and having a cam, and a rocker arm angularly movable by said cam, and wherein the rocker arm of said second valve actuating means having a roller tappet rollingly engaging the cam thereof.

* * * * *